US006824298B2

(12) United States Patent
Childs

(10) Patent No.: US 6,824,298 B2
(45) Date of Patent: Nov. 30, 2004

(54) LOCK-A-LITE MOUNTING BRACKET

(76) Inventor: Henry Turner Childs, P.O. Box 9128, Chattanooga, TN (US) 37412

( * ) Notice: Subject to any disclaimer, the term of this patent is extended or adjusted under 35 U.S.C. 154(b) by 102 days.

(21) Appl. No.: 10/233,389

(22) Filed: Sep. 3, 2002

(65) Prior Publication Data

US 2004/0042222 A1 Mar. 4, 2004

(51) Int. Cl.[7] ..... F21S 13/02

(52) U.S. Cl. ..... 362/432; 362/147; 362/404; 362/457

(58) Field of Search ..... 362/432, 147, 362/148, 404–408, 453, 454, 457, 365, 366; 248/207

(56) References Cited

U.S. PATENT DOCUMENTS 3,506,232 A * 4/1970 Wolar et al. ..... 248/320
2002/0085373 A1 * 7/2002 Slesinger et al. ..... 362/127

* cited by examiner

*Primary Examiner*—Alan Cariaso
*Assistant Examiner*—Mark Tsidulko

(57) ABSTRACT

A designed mounting bracket and method for quick coupling a hanging type light fixture to an electrical ceiling box. The designed mounting bracket serves as a lintel across the open base ceiling box by being securely fastened at each end. The bracket, having parallel sides, is sufficient in width and thickness to support the light fixture's weight, and contains parallel perpendicular flanges extending down each side, for rigidity. A slot containing a 180 degree arc, positioned near the center edge, is sufficient in size for immediate acceptance of the light fixture's nipple and nut, thus quick coupling the hanging fixture to the ceiling box.

2 Claims, 3 Drawing Sheets

9
8
4
2
10
11
3
5

4
8
10
11
2
6
3

3
10
2
11
5

LOCK-A-LITE MOUNTING BRACKET

BACKGROUND OF THE INVENTION

There are various designs of light fixtures in use today that are connected to, or positioned to hang from an electrical ceiling box. Some are positioned flush with the ceiling, such as a bedroom ceiling fixture, while others are positioned to hang from the ceiling box by means of support, such as chains, ropes, or even the fixture's own electrical cord.

At present, the assembly and installation of hanging a light fixture to its respective ceiling box presents the installer with a cumbersome and unwieldy job. He assembles his assigned fixture, then positions himself in an elevated position and holds the fixture against the ceiling box, while coupling the light fixture to the ceiling box's mounting strip.

Another method of hanging a light fixture is for the installer to install the fixture's nipple, with its chain holder attached, into the ceiling box's mounting strap, then after assembling the fixture's canopy, chain, collar, and wiring parts, raise the assembly to the ceiling box and, while standing in an elevated position, hold the assembly in place, while connecting the chain to the nipple's chain holder and threading the wires up through the nipple into the ceiling box. Either present method of installation offers a cumbersome and unwieldy method of installation.

This invention offers an improved method and apparatus for the electrical installer to couple his assembled light fixture to its respective ceiling box. After assembling the light fixture and attaching the lintel type Lock-A-Lite mounting bracket to the ceiling box, the installer can, with one hanging motion, hook the assembled fixture's nipple and nut to its respective ceiling box's Lock-A-Lite mounting bracket, thus eliminating a cumbersome job.

This invention relates to a method and apparatus for improving the coupling of an electrical light fixture to its respective ceiling box.

SUMMARY OF THE INVENTION

The purpose of this invention is to provide an improved, inexpensive method and apparatus for coupling an electrical light fixture to its respective electrical ceiling box.

Various other features of the method and apparatus of the present invention will become obvious to those skilled in the art upon reading the disclosure set forth hereinafter.

BRIEF DESCRIPTION OF DRAWINGS

Corresponding reference characters indicate corresponding parts throughout the view of the drawings.

DETAILED DESCRIPTION

Figure 1:
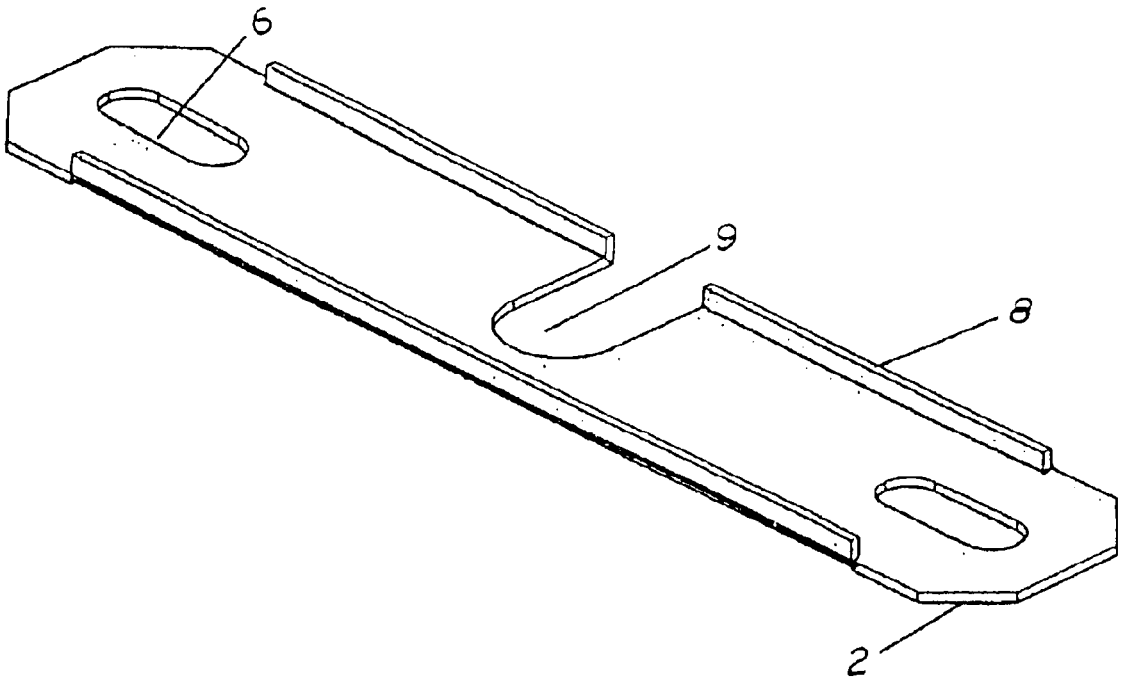
FIG. 1 is a view of the apparatus, Lock-A-Lite, showing its features and design, to be used as a lintel to span the open base electrical ceiling box.
Figure 2:
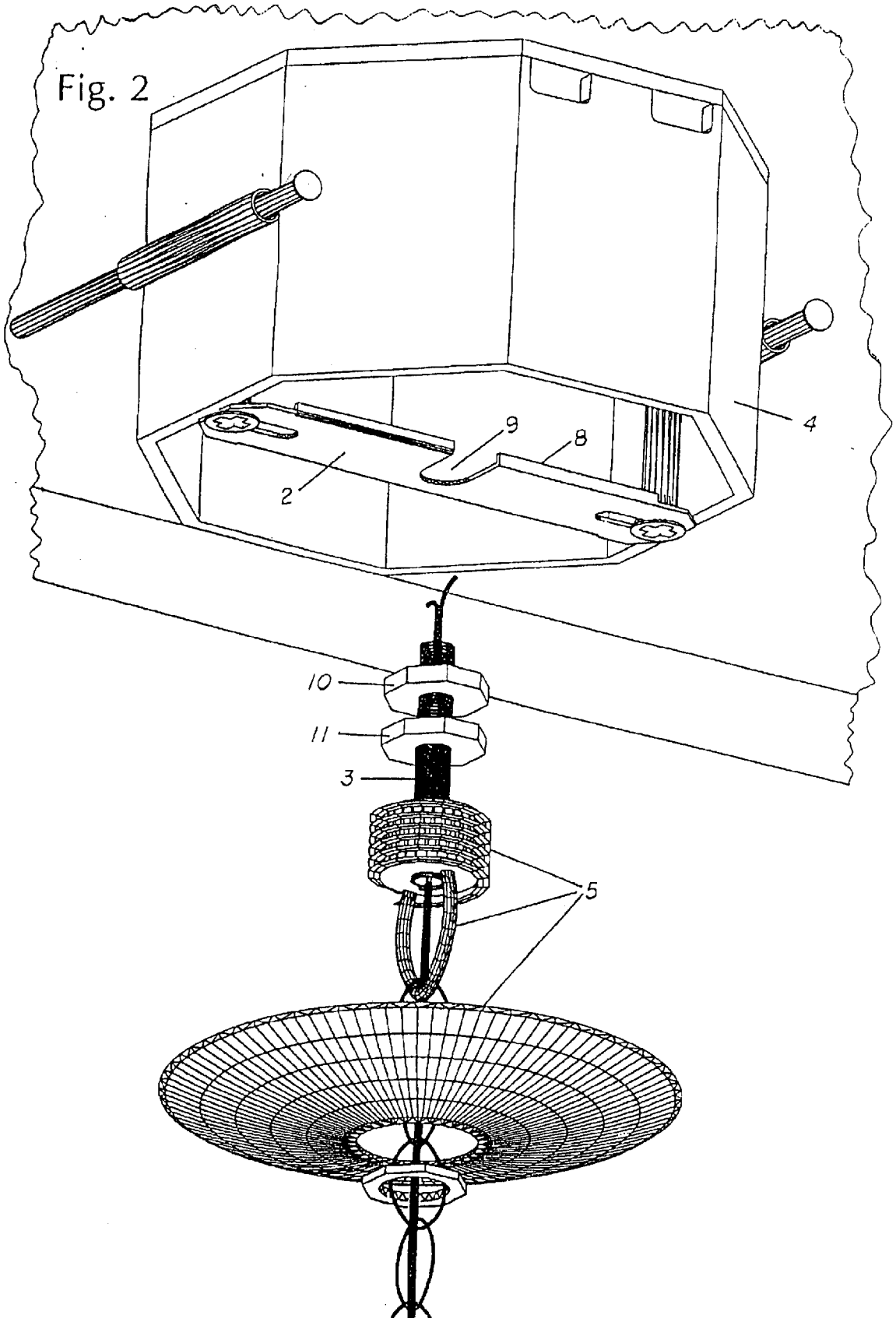
FIG. 2 shows the Lock-A-Lite mounting bracket connected in its lintel position across the open base of the ceiling box with the proposed hanging light fixture positioned below, representing a typical mounting assembly prior to mounting.
Figures 3, 4:
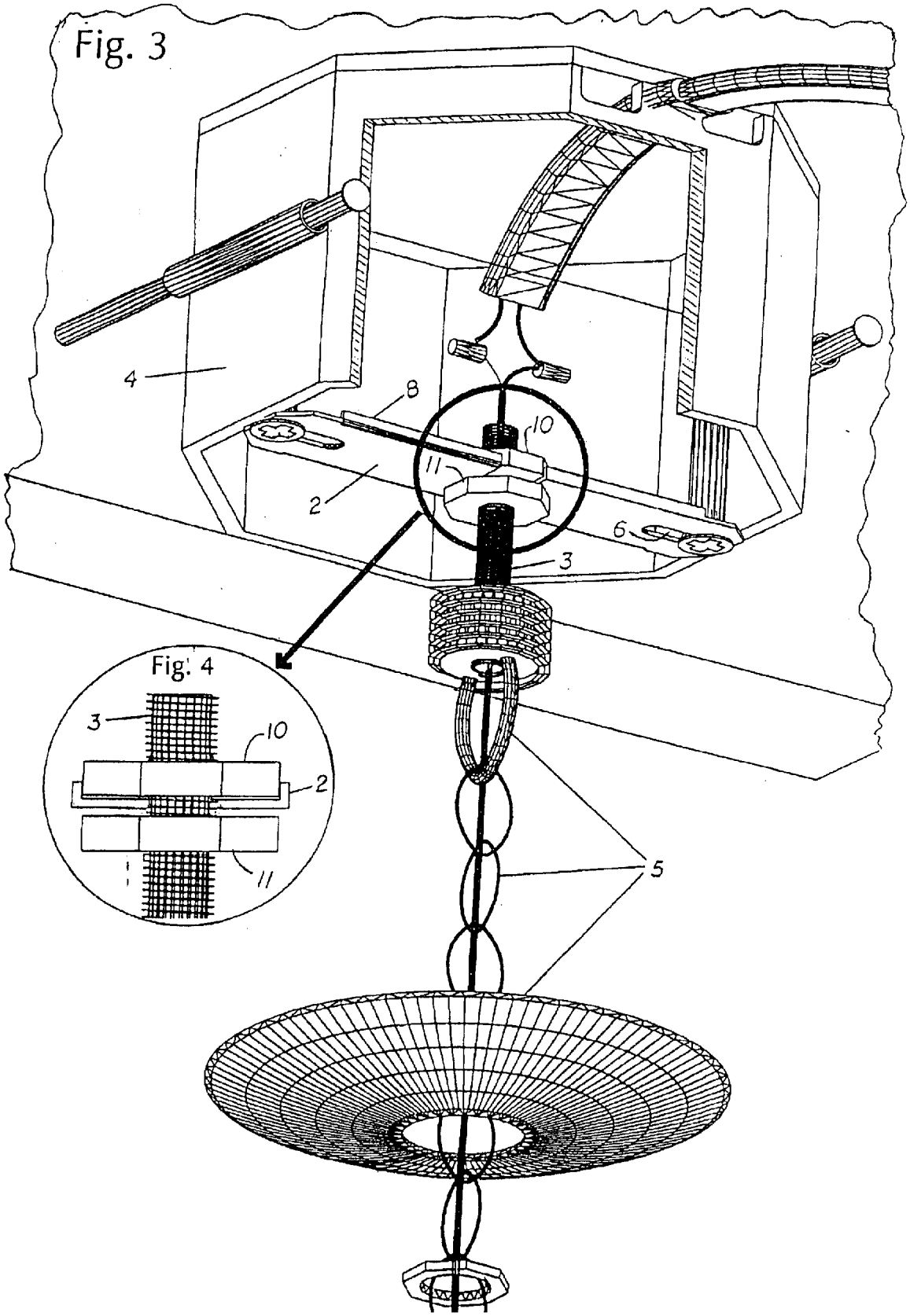
FIG. 3 illustrates a cut-a-way view of the ceiling box and its Lock-A-Lite mounting bracket showing a typical mounting assembly of the light fixture after mounting.
FIG. 4 shows an enlarged view of the light fixture's mounting assembly in relation to the Lock-A-Lite mounting bracket.

There is illustrated in FIG. 1 of the four drawing figures, the quick coupling Lock-A-Lite mounting bracket 2, with lintel features, and that has parallel sides and is the length suitable to span the diameter of an electrical open base ceiling box 4 (see FIGS. 2 & 3), and the width and thickness to support the weight of a specific electrical hanging light fixture 5 (see FIGS. 2 & 3). Positioned in each end of the bracket is a slot 6 that will align with the specific holes in the lower sides of the ceiling box 4, and having means for fastening each end of the bracket to the ceiling box 4. Positioning down opposite lineal sides is matching perpendicular coinciding flanges 8, extending parallels the approximate length of the bracket 2, for rigidity. Located near the center of one side of bracket 2 is a slot 9, containing a 180° degree arc, extending into the width of the bracket 2 sufficiently to accommodate the light fixture's outer threaded nipple 3 (see FIG. 2 & 3) and its upper positioned nut 10 (see FIGS. 2, 3, & 4). The lower nut 11, positioned on the nipple 3 below the upper nut 10 is adjusted to allow space for quick coupling the light fixture's nipple 3 and upper nut 10 to the Lock-A-Lite mounting bracket 2. After hanging the light fixture, 3 the lower positioned nut 11 on the nipple 3 can then be raised until its desired adjustment is reached, with the bottom of the bracket 2.

The electrician's preparation for hanging an electrical light fixture to its respective ceiling box, consists of the positioning the Lock-A-Lite mounting bracket, with its perpendicular flanges in an up position, and the bracket's end slots, with attaching means, attached to the corresponding means of attachment on the open base ceiling box. This positions the Lock-A-Lite bracket for receiving its corresponding hanging light fixture, when assembled. After assembly, the installer raises the fixture by its nipple, adjusts the nipple's two nuts apart, and with one motion, hangs the fixture to the Lock-A-Lite bracket. Any adjustment of the nipple nuts 10 and 11 against the Lock-A-Lite bracket completes the cumbersome job made simple.

Any appropriate wiring in the ceiling box is ready for completion.

It is to be understood that the foregoing drawings and description of the invention is to be taken as a preferred embodiment and that various other modifications will occur to those skilled in the art upon reading the disclosure, however, all changes and modifications that come within the spirit of the invention are desired to be protected.

What is claimed is:

1. A method for quick coupling light fixture to a ceiling box, comprising the steps of:

removing a supporting bracket from the ceiling electrical box;

installing near the center of the bracket an open slot containing 180 degrees arc on a flat body of the bracket and sized to accept a nipple of a hanging light fixture;

installing perpendicular coinciding flanges down opposite lineal sides of the bracket;

re-attaching the supporting bracket to the respective ceiling box, thus establishing a method of quick coupling a hanging ceiling light fixture.

2. An apparatus for quick coupling a light fixture to a ceiling box, comprising:

a supporting bracket removed from the ceiling box;

the support bracket comprising a flat body having an open slot containing 180 degrees arc constructed near the center of the supporting bracket and sized to accept a nipple attached to a light fixture;

perpendicular coinciding flanges positioned down opposite lineal sides of the bracket;

the supporting bracket being re-attached to the respective ceiling box, thus forming an apparatus for quick coupling a hanging light fixture.

* * * * *